United States Patent [19]

Ecker

[11] 4,217,765

[45] Aug. 19, 1980

[54] HEAT EXCHANGER-ACCUMULATOR

[75] Inventor: Amir L. Ecker, Dallas, Tex.

[73] Assignee: Atlantic Richfield Company, Los Angeles, Calif.

[21] Appl. No.: 45,392

[22] Filed: Jun. 4, 1979

[51] Int. Cl.[2] ..... F25B 43/00

[52] U.S. Cl. ..... 62/503; 62/513

[58] Field of Search ..... 62/503, 513

[56] References Cited

U.S. PATENT DOCUMENTS

| | | | |
|---|---|---|---|
| 3,488,678 | 1/1970 | Wagner | 62/503 |
| 3,563,053 | 2/1971 | Bottum | 62/503 |
| 3,600,904 | 8/1971 | Tilney | 62/503 |
| 3,609,990 | 10/1971 | Bottum | 62/503 |
| 3,621,673 | 11/1971 | Foust | 62/503 |

*Primary Examiner*—Ronald C. Capossela

*Attorney, Agent, or Firm*—Wofford, Fails & Zobal

[57] ABSTRACT

What is disclosed is a heat exchanger-accumulator for vaporizing a refrigerant or the like, characterized by an upright pressure vessel having a top, bottom and side walls; an inlet conduit eccentrically and sealingly penetrating through the top; a tubular overflow chamber disposed within the vessel and sealingly connected with the bottom so as to define an annular outer volumetric chamber for receiving refrigerant; a heat transfer coil disposed in the outer volumetric chamber for vaporizing the liquid refrigerant that accumulates there; the heat transfer coil defining a passageway for circulating an externally supplied heat exchange fluid; transferring heat efficiently from the fluid; and freely allowing vaporized refrigerant to escape upwardly from the liquid refrigerant; and a refrigerant discharge conduit penetrating sealingly through the top and traversing substantially the length of the pressurized vessel downwardly and upwardly such that its inlet is near the top of the pressurized vessel so as to provide a means for transporting refrigerant vapor from the vessel. The refrigerant discharge conduit has metering orifices, or passageways, penetrating laterally through its walls near the bottom, communicating respectively interiorly and exteriorly of the overflow chamber for controllably carrying small amounts of liquid refrigerant and oil to the effluent stream of refrigerant gas.

6 Claims, 3 Drawing Figures

HEAT EXCHANGER-ACCUMULATOR

BACKGROUND OF THE INVENTION

1. Field of the Invention

This invention is in the field of refrigerant systems or heat pump systems. More particularly, it is a heat exchanger-accumulator that can be used as an evaporator on the suction side of a compressor for such a heat pump system.

2. Description of the Prior Art

In the prior art, each of the refrigerant or heat pump systems has had a piece of equipment to transfer heat to or from the refrigerant. Particularly in heat pump systems, heat is absorbed by the refrigerant by vaporizing the condensed liquid which then allows refrigerant to be taken into the compressor as a gas.

There have been many types of heat transfer systems for accomplishing this. For example, there have been systems for heat exchanging directly with ambient air such as air to air heat pumps. The problem with these systems during the heating mode is the formation of condensation followed by a freezing of the liquid condensate to block the air passageways on the evaporator surface. There have been employed also liquid-liquid heat pump systems in which liquids, such as water from wells penetrating the earth formations, were used as the heat source to vaporize the liquid refrigerant. These systems have employed expensive dual pipe arrangements in which an inner conduit was maintained concentrically within an outer conduit. As a consequence, there has been no place for the liquid refrigerant to separate from the general vapors and the vapors occupy heat transfer surface and serve to reduce heat transfer. This increased the expense of such equipment and has detrimental impact on system efficiency. Moreover, the pressure drop through such conventional tube-in-tube heat exchanges has hurt performance of the heat pump unit, particularly where such devices were connected in series flow path configuration as was the usual practice.

Typical of the prior art are the following articles and patents.

In the January, 1979 issue of "Air Conditioning and Refrigeration Business," there is an article entitled "Suction-line Accumulators for Heat Pumps;" Darwin R. Grahl.

Typical of the U.S. patents are the following: Nos. 3,242,679 shows a solar unit with pipes in the evaporator. 3,488,678 shows a u-pipe with a capillary in the bottom and with a separate inlet. 3,512,374 shows a suction accumulator with an inline intake-discharge. 3,563,053 shows a suction accumulator with similar tube arrangement to 3,488,678. 3,600,904 shows liquid level sensor in an accumulator. 3,609,990 shows a suction accumulator with a tube arrangement similar to 3,488,678. 3,765,192 shows an evaporator with a coil and a spray to spray liquid up on the coil with an exterior space around the coil for passage of the gas to the top outlet.

From the foregoing, it can be seen that none of the prior art approaches show the desirable feature of having the safety of an overflow chamber in an accumulator and having a properly sized unit with a vertical pressure vessel small enough to keep the refrigerant charge low and make more nearly universal and economically feasible the heat pump systems, especially multi-coil heat recovery sustems or solar assisted heat pumps.

Moreover, none of the prior art had the desirable feature that the unit can be employed to retro fit, or fit into an existing units, means to efficiently use supplemental heat sources to make economically feasible the heat pump units even in areas that did not have readily available solar energy, relatively high winter temperatures or the like.

SUMMARY OF THE INVENTION

Accordingly it is the object of this invention to provide a heat exchanger-accumulator that obviates the disadvantages of the prior art and provides one or more of the features delineated hereinbefore as being desirable.

It is a particular object of this invention to provide a heat exchanger-accumulator that satisfies the foregoing object and achieves all of the features hereinbefore as desirable and not hereinbefore provided.

These and other objects will become apparent from the descriptive matter hereinafter, particularly when taken in conjunction with the appended drawings.

In accordance with this invention, there is provided a heat exchanger-accumulator for vaporizing a refrigerant or the like comprising:

a. an upright pressurized vessel having a top, bottom and side walls;

b. an inlet conduit concentrically and sealingly penetrating through the top so as to discharge the refrigerant downwardly along the side wall;

c. a tubular overflow chamber disposed concentrically within the vessel and sealingly connected with the bottom so as to define also an annular concentric outer volumetric chamber for receiving the refrigerant such that liquid will settle toward the bottom;

d. a heat transfer coil disposed in the annular concentric outer volumetric chamber for vaporizing the liquid refrigerant; the heat transfer coil comprising a coil defining a passageway for a heat exchange fluid and having means for transferring the heat efficiently into the refrigerant and for freely allowing vaporized refrigerant to escape upwardly from the liquid refrigerant; the coil having inlet and outlet conduit means for conducting the fluid and penetrating laterally through the walls of the pressure vessel; the heat transfer coil traversing longitudinally, with its row of coils, of the pressurized vessel from adjacent of the top of the overflow chamber to the bottom;

e. refrigerant discharge conduit means for effluent refrigerant; said refrigerant discharge conduit means penetrating sealingly through the top, extending downwardly adjacent the bottom back upwardly to have its inlet end adjacent the top of the vessel; the refrigerant discharge conduit means having metering passageways, or orifices, penetrating laterally through its walls near the bottom; at least one of the metering passageways communicating interiorly of the overflow chamber adjacent its bottom and at least one of the metering passageways communicating with the annular concentric volumetric chamber adjacent its bottom; the metering passageways controllably carrying small amounts of liquid refrigerant and oil into the effluent stream of refrigerant gas.

DESCRIPTION OF THE PREFERRED EMBODIMENTS

This invention is susceptible of a variety of uses. It may be employed anywhere there is a readily vaporizable liquid that comes in through an inlet conduit, the gas being discharged through an outlet conduit and where a heated fluid can be circulated through a high flux heat exchange means to vaporize the liquid. It is for the art of refrigerant type air conditioning or heat pump systems, however, that this invention was designed and it will be described specifically in that environment.

Figure 2:
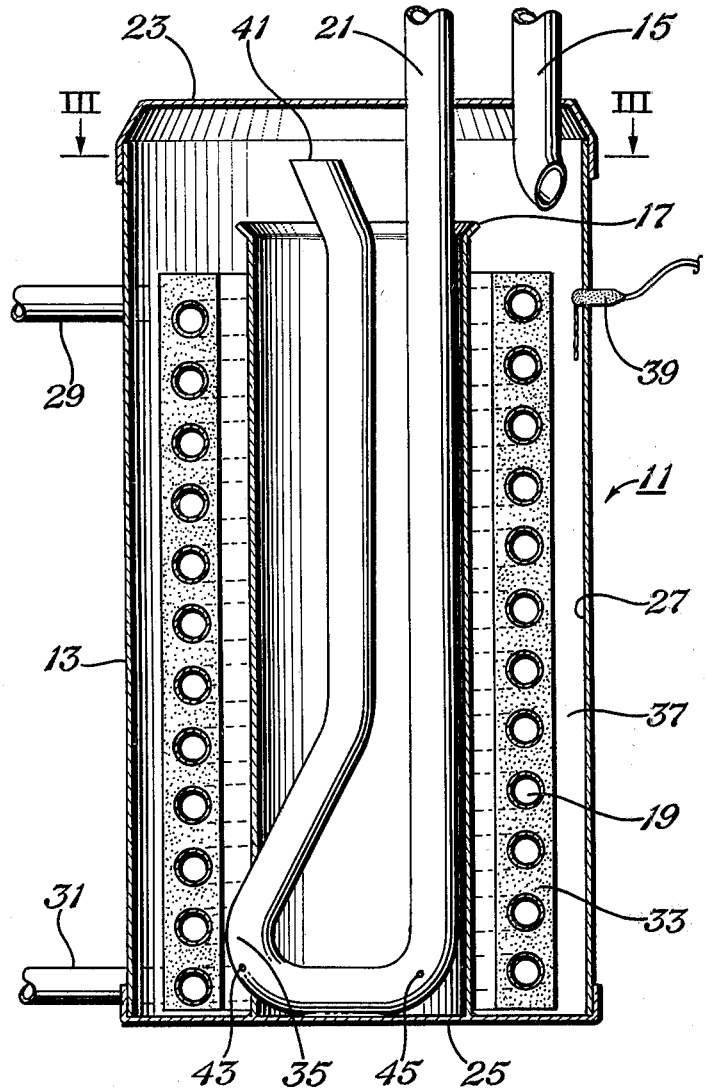
FIG. 2 is a cross-sectional view of the embodiment of FIG. 1.
Figure 1:
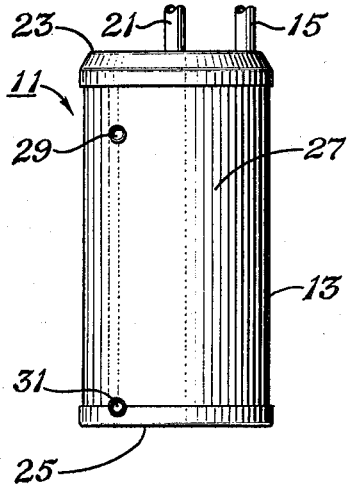
FIG. 1 is a side elevational view of one embodiment of this invention.
Figure 3:
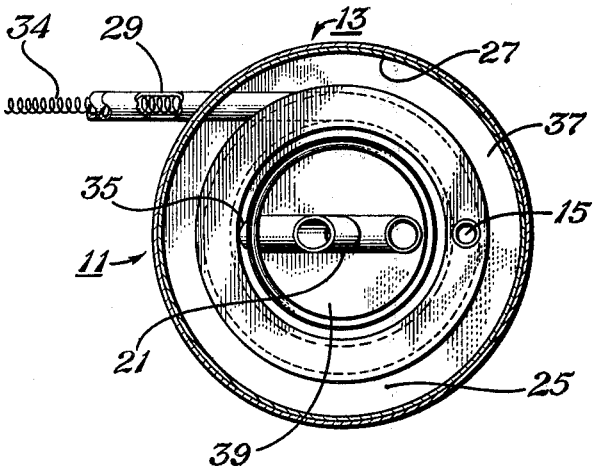
FIG. 3 is a cross-sectional view taken along III—III of FIG. 2.

Referring to the FIGS. 1-3, the heat exchanger-accumulator 11 includes an upright pressure vessel 13; an inlet conduit 15, tubular overflow chamber 17, FIG. 2; a heat transfer coil 19, and a refrigerant discharge conduit 21.

The upright pressure vessel 13 has a top 23, a bottom 25, and side walls 27.

The pressure vessel 13 may be of any shape such as square, cyclindrical, ellipsodial, rectangular, or the like. As illustrated, it is a cyclindrical container to which the top and bottom are sealingly connected.

The pressure vessel 13 may be formed of any material that will handle the structural demands made on it. As illustrated, it is formed of a metal such as steel, although aluminum, copper, or the like may be employed. The top and bottom are preferably sealingly affixed after the elements are inserted interiorly of the pressure vessel. They may be affixed by bonding, thermally or chemically. Preferably, the top and bottom are silver soldered, or welded to complete the pressure vessel. Before the top and bottom are assembled, however, the respective elements are inserted therewithin. Ordinarily, the overflow chamber is sealingly connected with the bottom as by welding and is formed of similar material as the side wall of the pressure vessel.

The inlet conduit 15 may be a simple ended conduit as shown. On the other hand it may be bent, crumpled, or shaped to impart centrifugal motion to the incoming refrigerant. This centrifugal motion causes impingement on the wall of liquid refrigerant and reduces entrainment of liquid in the discharged gaseous refrigerant.

Ordinarily, also, the heat transfer coil will be formed separately and then inserted within the tubular shell of the pressure vessel with the inlet and outlet conduits 29 and 31 inserted through the side wall of the pressure vessel 13 and sealingly connected therewith. For example, they may be silver soldered, or otherwise bonded into place. Ordinarily the coil 19 is formed into a annular or helical coil so as to afford a continuous flow path for a heat exchange liquid or fluid to vaporize the refrigerant interiorly of the pressure vessel 13. If desired, the coil 19 may merely comprise a sufficient number of turns to perform the desired heat transfer. As illustrated, the coil 19 has a high flux means 33 surrounding it to increase the efficiency of heat transfer from the coil into the refrigerant and to allow vaporized refrigerant to escape upwardly. High flux means 33 may take the form of grooved tubing, finned tubing, high flux fins, sintered copper, or the like. Typical of the sintered copper, or sintered bronze is the high flux tubing available from Union Carbide. This is advantageous in that it provides nucleation sites and a large surface area that allows the liquid refrigerant that is converted to gas to escape readily upwardly without taking up surface area. Expressed otherwise, high flux heat transfer means affords a free surface boiling for evaporating the refrigerant responsive to the flow of the heat exchange fluid through the coil 19 and allows the vapor to pass upwardly to minimize the pressure drop which is deleterious to system performance. Spring coils 34, FIG. 3, or the like inserted within the tubing allow for internal heat transfer coefficient enhancement by disrupting the laminar sublayer. This serves to improve the overall heat transfer, since the heat exchanger becomes internally film coefficient limited if the external high heat flux means is employed.

The refrigerant discharge conduit 21 and the overflow chamber 17 may be formed advantageously together with the radially outwardly protruding ell 35, FIGS. 2 and 3, penetrating exteriorly of the overflow chamber 17 so as to enable its metering passageways to pick up liquid refrigerant or oil.

The tubular overflow chamber 17 is disposed within the vessel and sealingly connected with the bottom so as to define also an annular concentric outer volumetric chamber 37, FIG. 2. The overflow chamber may have any shape and be disposed eccentrically or concentrically within the vessel 13. The concentric outer annular volumetric chamber 37 receives incoming refrigerant such that liquid will settle towards the bottom. The inner overflow chamber does not receive liquid refrigerant until it overflows the top of the overflow chamber 17.

A liquid level sensor 39 is provided near the level of the top of the overflow chamber 17 to provide a means of controlling the refrigerant volume in the vessel. This sensor can be of the variable output type used to control one of several types of refrigerant metering devices to afford proper control of the liquid level within the heat exchanger-accumulator. In the event the liquid level exceeds the sensor location, liquid refrigerant flow into the device is ceased. The sensor 39 may also incorporate a fail-safe feature for emergency action if the liquid gets too high. This would prevent too much liquid refrigerant from being taken into the refrigerant discharge conduit 21 and thence to the compressor (not shown).

The refrigerant discharge conduit penetrates sealingly through the top and extends downwardly adjacent the bottom of both the overflow chamber and the annular outer chamber with its inlet 41 exposed adjacent the top for picking up gaseous refrigerant. The refrigerant discharge conduit can comprise an inner tube disposed interiorly of a larger outer tube that is sealed at its bottom end and has its inlet aperture near the top of the pressure vessel 13. As illustrated, it comprises a U-shaped tube having functionally the same traverse.

The inlet and discharge conduits penetrate sealingly through the top 23.

Disposed near the bottom of the annular outer chamber and the overflow conduit are respective metering passageways 43, 45, FIG. 2. The respective metering passageways are for allowing controlled and small amounts of liquid refrigerant and oil to be picked up with the effluent refrigerant gases and used to lubricate the compressor and the like. The metering passageways may be merely metering orifices, small apertures or capillaries.

After all of the elements are inserted, the top and bottom are sealingly connected with the pressure vessel and their respective conduits connected with the other elements of the heat pump system.

In operation, the refrigerant enters inlet conduit 15, which may be formed of copper, aluminum, or any of the conventional materials. It is directed into the annular volumetric chamber 37 of the pressure vessel on which the top and bottom are sealingly affixed. The inlet and outlet conduits 29–31 of the heat transfer coil 19 are connected with a heat exchange fluid. The fluid may be a fluid to be cooled; for example; to generate chilled water for cooling purposes. On the other hand the fluid may serve as a heat source for a heat pump operating in the heating mode. The heat source fluid may comprise any fluid; such as, heated via solar means, geothermal means, ground water, waste process fluid, or stack gas heat exchanger; for vaporizing the liquid refrigerant. The incoming liquid refrigerant tends to fall to the bottom of the annular chamber 37. The heat flows via the high flux means 33 from the fluid into the liquid refrigerant; through nucleation forming the bubbles of refrigerant which are free to flow upwardly through the liquid and not take up heat transfer surface. Consequently, there is an efficient transfer of heat to vaporize the refrigerant. The vaporized refrigerant flows to the top inlet 41 of the discharge conduit 21, which is ordinarily connected to the suction of the compressor.

As will be apparent from conventional knowledge, the compressor compresses the refrigerant to form a hot refrigerant gas which is then liquified in a condenser through the heat rejection process. Ordinarily, in a heat pump system the condensing is effected by passing in heat exchange relationship with the hot high pressure refrigerant gas, air that is circulated through a building, or enclosed space. Heat is taken away from the pressurized refrigerant gas, condensing the gas to form a liquid refrigerant. The liquid then flows through an expansion device and thence into the inlet conduit 15 of the exchanger-accumulator 11 where the liquid refrigerant is again vaporized.

As the liquid begins to build up in the unit, the vaporization, or boiling, increases. As indicated if the liquid level should build high enough, the sensor 39 controllably effected the action described hereinbefore. Should this not be fast enough to stem the influx of liquid refrigerant, liquid refrigerant would overflow into the interior overflow chamber 17 to provide a safety factor without requiring a large bulky accumulator or the like. The liquid then slowly boils from the overflow chamber.

From the foregoing, it can be seen that the heat exchanger-accumulator is very valuable. It is preferably smaller in lateral diamension; e.g. diameter; than in height. For residential applications, it may be formed in sized from as low as 6 inches to as high as 36 inches or larger. Preferably, the sizes are about 12–30 inches in height. The 12 inch units are been found adequate to handle most heat pumps in the range of about 30,000 BTU size. For commercial applications, the exchanger-accumulator may be substantially larger. The larger units will enable handling much larger units with safety and efficiency and without demanding excessively large charges of refrigerant. Large charge volumes are inefficient and constitute potential refrigerant management problems which adversely affect system reliability.

From the foregoing, it can be seen that this invention effects the objects delinated hereinbefore and provides all of the features desirable but not hereinbefore provided.

Although the invention has been described with a certain degree of particularly, it is understood that the present disclosure is made only by way of example and that numerous changes in the details of construction and the combination and arrangement of parts may be resorted to without departing from the spirit and the scope of the invention, reference for the latter being had to the appended claims.

What is claimed is:

1. A heat exchanger-accumulator for vaporizing a refrigerant or the like, comprising:

a. an upright, pressure vessel having top, bottom, and side walls;

b. an inlet conduit eccentrically and sealingly penetrating through said top so as to discharge said refrigerant downwardly along said side wall of said pressurized vessel when refrigerant flows through said inlet conduit;

c. a tubular overflow chamber disposed within said vessel and sealingly connected with said bottom so as to define also an annular outer volumetric chamber for receiving said refrigerant such that liquid refrigerant will settle toward the bottom, being isolated from the liquid in said outer volumetric chamber until said liquid overflows the top of said overflow chamber;

d. a heat transfer coil disposed in said annular outer volumetric chamber for vaporizing liquid said refrigerant; said heat transfer coil comprising a coil defining a passageway for heat exchange fluid and having means for transferring heat efficiently from said fluid to said refrigerant and freely allowing vaporized refrigerant to escape upwardly from the liquid said refrigerant; said coil having inlet and outlet conduit means for conducting said fluid and penetrating laterally through said walls of said pressure vessel; said heat transfer coil traversing longitudinally of said pressurized vessel from adjacent the top of said overflow chamber to adjacent said bottom;

e. refrigerant discharge conduit means for carrying effluent refrigerant; said refrigerant discharge conduit means penetrating sealingly through said top, extending downwardly adjacent said bottom and back upwardly to have its inlet disposed adjacent said top have said overflow chamber; said refrigerant discharge conduit having metering passageways penetrating laterally through said conduit means near said bottom for allowing a controlled flow of liquid into said discharge conduit, at least one said metering passageway communicating interiorly of said overflow chamber adjacent its bottom and at least one said metering passageway communicating with said annular outer volumetric chamber adjacent its bottom; said metering passageways serving to controllable carry small amounts of a liquid refrigerant and oil that may accumulate into the effluent stream of refrigerant gas.

2. The heat exchanger-accumulator of claim 1 wherein said pressure vessel is substantially cylindrical and said overflow chamber is substantially cylindrical.

3. The heat exchanger-accumulator of claim 1 wherein said overflow chamber is disposed concentrically within the vessel.

4. The heat exchanger-accumulator of claim 1 wherein said heat transfer coil comprises a high heat flux means exteriorly of the coil for heat transfer enhancement.

5. The heat exchanger-accumultor of claim 4 wherein said heat transfer coil comprises a coil of conduit having sintered metal contiguous thereto.

6. The heat exchanger-accumulator of claim 4 wherein includes a heat transfer enhancement means exteriorly and interiorly of said conduit.

* * * * *